US008523548B2

(12) United States Patent
Hossain et al.

(10) Patent No.: US 8,523,548 B2
(45) Date of Patent: Sep. 3, 2013

(54) SCREW COMPRESSOR HAVING A GATE ROTOR ASSEMBLY WITH PRESSURE INTRODUCTION CHANNELS

(75) Inventors: Mohammod Anwar Hossain, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 459 days.

(21) Appl. No.: 12/810,432

(22) PCT Filed: Dec. 26, 2008

(86) PCT No.: PCT/JP2008/003993

§ 371 (c)(1),
(2), (4) Date: Jun. 24, 2010

(87) PCT Pub. No.: WO2009/084218

PCT Pub. Date: Jul. 9, 2009

(65) Prior Publication Data

US 2010/0278677 A1 Nov. 4, 2010

(30) Foreign Application Priority Data

Dec. 28, 2007 (JP) ..... 2007-339440

(51) Int. Cl.
*F01C 1/08* (2006.01)

(52) U.S. Cl.
USPC ..... 418/195; 418/201.1; 418/201.3

(58) Field of Classification Search
USPC ..... 148/74, 78, 79, 201.1, 201.3, 195; 418/74, 78, 79, 195, 201.1, 201.3
See application file for complete search history.

(56) References Cited

U.S. PATENT DOCUMENTS

| | | | | |
|---|---|---|---|---|
| 1,439,628 | A * | 12/1922 | Kien | 418/85 |
| 3,180,565 | A * | 4/1965 | Zimmern | 418/99 |
| 3,433,167 | A * | 3/1969 | Craig | 123/204 |
| 4,900,239 | A | 2/1990 | Zimmern | |
| 5,762,483 | A | 6/1998 | Lifson et al. | |
| 2004/0037730 | A1 | 2/2004 | Ueno et al. | |

FOREIGN PATENT DOCUMENTS

| | | | |
|---|---|---|---|
| JP | 56-13587 | U | 7/1979 |
| JP | 2-5778 | A | 1/1990 |
| JP | 10-213083 | A | 8/1998 |
| JP | 2001-65481 | A | 3/2001 |
| JP | 2002-202080 | A | 7/2002 |

OTHER PUBLICATIONS

Heinz P. Bloch. "Compressors and Modern Process Applications," John Wiley & Sons, Inc; Section 2.5.3 Internal Seals.*

* cited by examiner

*Primary Examiner* — Theresa Trieu
*Assistant Examiner* — Paul Thiede
(74) *Attorney, Agent, or Firm* — Global IP Counselors

(57) ABSTRACT

A single-screw compressor includes a casing, a screw rotor accommodated in the casing, a gate rotor, and a gate rotor supporting member rotatably supporting the gate rotor. The gate rotor includes a plurality of flat-plate-shaped gates formed in a radial pattern and meshing with a helical groove of the screw rotor. Fluid in a compression chamber defined by the screw rotor, the casing and the gates is compressed when the screw rotor is rotated. The gate rotor supporting member includes a gate supporting portion supporting each gate from a back surface side. The gate rotor and the gate rotor supporting member form a gate rotor assembly including a pressure introduction channel configured and arranged to introduce a fluid pressure on a front surface side of each gate into a gap between a back surface of the gate and the gate supporting portion.

13 Claims, 14 Drawing Sheets

SCREW COMPRESSOR HAVING A GATE ROTOR ASSEMBLY WITH PRESSURE INTRODUCTION CHANNELS

CROSS-REFERENCE TO RELATED APPLICATIONS

This U.S. National stage application claims priority under 35 U.S.C. §119(a) to Japanese Patent Application No. 2007-339440, filed in Japan on Dec. 28, 2007, the entire contents of which are hereby incorporated herein by reference.

TECHNICAL FIELD

The present invention relates to techniques for improving the reliability of a single-screw compressor.

BACKGROUND ART

Single-screw compressors have been used in the art as compressors for compressing refrigerant or air. For example, Japanese Published Patent Application Nos. 2002-202080 and 2001-065481 disclose a single-screw compressor including a screw rotor and two gate rotors.

The single-screw compressor will be described. In the single-screw compressor, a screw rotor is accommodated in a casing. The screw rotor is formed generally in a cylindrical shape with a plurality of helical grooves cut in the outer circumferential portion thereof. Each gate rotor is formed generally in a flat plate shape and arranged beside the screw rotor. The gate rotor is provided with a plurality of rectangular plate-shaped gates arranged in a radial pattern. The gate rotor is installed in such an orientation that the rotation axis thereof is perpendicular to the rotation axis of the screw rotor, with the gates meshed with the helical grooves of the screw rotor. In a typical single-screw compressor, a gate rotor is formed as a flat-plate shape resin, and is attached to a metal supporting member having a rotation shaft portion.

In the single-screw compressor, the screw rotor and the gate rotor are accommodated in a casing, and a compression chamber is formed by the helical grooves of the screw rotor, the gates of the gate rotors, and the inner wall surface of the casing. As the screw rotor is rotated by an electric motor, etc., the gate rotor is rotated by the rotation of the screw rotor. Then, the gates of the gate rotors relatively move from the start end (the suction side end portion) to the terminal end (the discharge side end portion) of a meshing helical groove, thereby gradually reducing the volume of the closed compression chamber. As a result, the fluid in the compression chamber is compressed.

In a single-screw compressor in operation, the front surface side of a gate meshed with a helical groove of the screw rotor serves as a compression chamber in the compression phase (i.e., a compression chamber in a closed state), and the back surface side of the gate serves as a compression chamber in the suction phase (i.e., a compression chamber that communicates with the suction side). The pressure of a compressed fluid acts upon the front surface of a gate meshed with a helical groove of the screw rotor, and the pressure of an uncompressed fluid acts upon the back surface thereof. Therefore, a gate meshed with a helical groove of the screw rotor receives a force acting thereupon in such a direction as to push the gate to the back surface side thereof. On the other hand, the gate is supported by a supporting member from the back surface side thereof. Thus, the supporting member receives a force that pushes the gate to the back surface side, and the gate will not therefore be damaged by receiving a fluid pressure in the compression chamber.

SUMMARY

Technical Problem

As described above, a gate is supported by a supporting member from the back surface side thereof. That is, the supporting member is in contact with the back surface of each gate. However, at the contact portion between the gate and the supporting member, they are not in complete contact with each other, and there is a small gap therebetween. The gap between the gate and the supporting member communicates with the compression chamber in the suction phase, and the internal pressure thereof is generally equal to the pressure of an uncompressed fluid. Therefore, if the pressure of a compressed fluid acts upon the front surface side of a gate meshed with a helical groove of the screw rotor, the gate may deform slightly due to the pressure difference between the front surface side and the back surface side of the gate.

On the other hand, the clearance between the circumferential portion of the gate and the wall surface of the helical groove of the screw rotor is set to a very small value in order to ensure the hermeticity of the closed compression chamber. Thus, when a gate deforms even slightly, the gate may come into direct contact with the screw rotor, thus wearing the gate. If the gate wears, the clearance between the circumferential portion of the gate and the wall surface of the helical groove of the screw rotor increases, thereby lowering the hermeticity of the compression chamber and lowering the performance of the single-screw compressor.

The present invention has been made in view of these problems, and has an object to reduce the wear of a gate meshed with a helical groove of a screw rotor by reducing the deformation of the gate, thereby reducing performance degradation of a single-screw compressor over time and thus improving the reliability thereof.

Solution to the Problem

A first aspect is directed to a single-screw compressor, including: a casing (10); a screw rotor (40) accommodated in the casing (10) and rotated; a gate rotor (50) including a plurality of flat-plate-shaped gates (51) formed in a radial pattern which are meshed with a helical groove (41) of the screw rotor (40); and a gate rotor supporting member (55) rotatably supporting the gate rotor (50), the single-screw compressor compressing a fluid in a compression chamber (23) defined by the screw rotor (40), the casing (10) and the gates (51). The gate rotor supporting member (55) includes a gate supporting portion (57) supporting each gate (51) from a back surface side thereof, and a gate rotor assembly (60) formed by the gate rotor (50) and the gate rotor supporting member (55) includes a pressure introduction channel (52) for introducing a fluid pressure on a front surface side of each gate (51) into a gap between a back surface of the gate (51) and the gate supporting portion (57) supporting the gate (51).

In the first aspect, the gate (51) of the gate rotor (50) is meshed with the helical groove (41) of the screw rotor (40). When the screw rotor (40) is rotated, the gate rotor (50) meshed with the helical groove (41) of the screw rotor (40) rotates, thereby compressing the fluid in the compression chamber (23). The gate rotor (50) is supported by the gate rotor supporting member (55). The gate supporting portion (57) of the gate rotor supporting member (55) is provided on the back surface side of each gate (51) of the gate rotor (50), and each gate supporting portion (57) supports a corresponding gate (51).

In the first aspect, the gate rotor (50) and the gate rotor supporting member (55) together form the gate rotor assembly (60). The gate rotor assembly (60) includes the pressure introduction channel (52). The pressure of the fluid in contact with the front surface of each of the plurality of gates (51) provided on the gate rotor (50) is introduced through the pressure introduction channel (52) into the gap between the gate (51) and the gate supporting portion (57) arranged on the back surface side thereof. That is, focusing on one gate (51), the fluid pressure on the front surface side of the gate (51) is introduced through the pressure introduction channel (52) into the gap between the gate (51) and the gate supporting portion (57) supporting the gate (51). In a state where the gate (51) is meshed with the helical groove (41) of the screw rotor (40), the fluid pressure in the compression chamber (23) located on the front surface side of the gate (51) is introduced to the back surface side of the gate (51). Therefore, each gate (51) of the gate rotor (50) receives, on the back surface thereof, a fluid pressure generally equal to the fluid pressure acting upon the front surface of the gate (51), thus reducing the difference between a force that pushes the gate (51) to the back surface side and a force that pushes the gate (51) to the front surface side.

A second aspect is according to the first aspect, wherein the pressure introduction channel (52) is at least one through hole provided for each gate (51) of the gate rotor (50), running through the gate (51) in a thickness direction thereof.

In the second aspect, at least one through hole provided for each gate (51) forms the pressure introduction channel (52). The pressure introduction channel (52) runs through the gate (51) in the thickness direction thereof. Focusing on one gate (51), the pressure introduction channel (52) formed in the gate (51) has one end thereof in communication with the space on the front surface side of the gate (51) with the other end thereof in communication with the gap between the gate (51) and the gate supporting portion (57) supporting the gate (51).

A third aspect is according to the second aspect, wherein the pressure introduction channel (52) is opened in a portion of a front surface of each gate (51) that is close to a center of the gate rotor (50).

In the third aspect, the pressure introduction channel (52) is opened in a portion of the front surface of each gate (51) that is close to the proximal end of the gate (51). Here, in the phase where the gate (51) comes out of the helical groove (41) of the screw rotor (40), the proximal end portion of the gate (51) first comes out of the helical groove (41) before the distal end portion does. Thus, focusing on one gate (51), a portion of the gate (51) close to the proximal end, where the pressure introduction channel (52) is opened, comes off the helical groove (41) at a relatively early point in time during the phase in which the gate (51) comes out of the helical groove (41) of the screw rotor (40). That is, the pressure introduction channel (52) opened in the front surface of the gate (51) is brought to a state where it is no longer in communication with the compression chamber (23) on the front surface side of the gate (51) at a relatively early point in time during the phase in which the gate (51) comes out of the helical groove (41) of the screw rotor (40).

A fourth aspect is according to the second aspect, wherein the pressure introduction channel (52) is opened in a portion of a front surface of each gate (51) that is close to a front side in a rotation direction of the gate rotor (50).

In the fourth aspect, the pressure introduction channel (52) is opened in a portion of the front surface of each gate (51) that is close to the front side in the rotation direction of the gate rotor (50) (i.e., the traveling direction of the gate (51)). Here, during the phase in which the gate (51) comes out of the helical groove (41), a portion of the gate (51) that is close to the front side in the rotation direction of the gate rotor (50) first comes out of the helical groove (41) of the screw rotor (40) before a portion of the gate (51) that is close to the rear side in the rotation direction of the gate rotor (50). Thus, focusing on one gate (51), a portion of the gate (51) where the pressure introduction channel (52) is opened (i.e., a portion that is close to the front side in the rotation direction of the gate rotor (50)) comes off the helical groove (41) at a relatively early point in time during the phase in which the gate (51) comes out of the helical groove (41) of the screw rotor (40). That is, the pressure introduction channel (52) opened in the front surface of the gate (51) is brought to a state where it is no longer in communication with the compression chamber (23) on the front surface side of the gate (51) at a relatively early point in time during the phase in which the gate (51) comes out of the helical groove (41) of the screw rotor (40).

A fifth aspect is according to the first aspect, wherein a back pressure space (65) is formed between each gate (51) and the gate supporting portion (57) supporting the gate (51), wherein a periphery of the back pressure space (65) is surrounded by a sealing member (66,67), and a fluid pressure on a front surface side of the gate (51) is introduced into the back pressure space (65) through the pressure introduction channel (52).

In the fifth aspect, the back pressure space (65) is formed between each gate (51) and the gate supporting portion (57) provided on the back surface side of the gate (51). Focusing on one gate (51), the fluid pressure on the front surface side of the gate (51) is introduced through the pressure introduction channel (52) into the back pressure space (65) formed on the back surface side of the gate (51). The periphery of the back pressure space (65) is surrounded by the sealing member (66,67). The sealing member (66,67) prevents the fluid from flowing out of the back pressure space (65).

A sixth aspect is according to the fifth aspect, wherein the sealing member (66,67) is arranged along a peripheral portion of the gate supporting portion (57).

In the sixth aspect, the sealing member (66,67) is arranged along the peripheral portion of the gate supporting portion (57), and the inside of the sealing member (66,67) serves as the back pressure space (65). That is, a large portion of the gap between each gate (51) and the gate supporting portion (57) located on the back surface side of the gate (51) serves as the back pressure space (65). A large portion of the back surface of each gate (51) faces the back pressure space (65).

A seventh aspect is according to the fifth aspect, wherein the sealing member (66) is attached to one of the gate (51) and the gate supporting portion (57) and is in contact with the other one of the gate (51) and the gate supporting portion (57), thereby defining the back pressure space (65).

In the seventh aspect, the sealing member (66) is attached to one of the gate (51) and the gate supporting portion (57). Where the sealing member (66) is attached to the gate (51), the sealing member (66) is in contact with the gate supporting portion (57). On the other hand, where the sealing member (66) is attached to the gate supporting portion (57), the sealing member (66) is in contact with the gate (51).

Advantages of the Invention

In the present invention, the gate rotor assembly (60) is provided with the pressure introduction channel (52) so that the fluid pressure on the front surface side of each gate (51) is introduced into the gap between the gate (51) and the gate supporting portion (57) supporting the gate (51) through the pressure introduction channel (52). Therefore, for each gate (51) of the gate rotor (50), the difference between a force that pushes the gate (51) to the back surface side and a force that pushes the gate (51) to the front surface side is reduced. This as a result reduces the deformation of the gate (51) due to the fluid pressure acting thereupon, and reduces the wear of the gate (51) due to the gate (51) deformed to come into direct contact with the screw rotor (40).

Therefore, according to the present invention, it is possible to reduce the wear of the gates (51) during the operation of a single-screw compressor (1), and it is possible to keep the hermeticity of the compression chamber (23) at a high level over a long period of time. As a result, it is possible to reduce the decrease in the performance of the single-screw compressor (1) for an increase in the operation time, and it is possible to improve the reliability of the screw compressor (1).

In the second aspect, the pressure introduction channel (52) is formed by a through hole running through the gate (51). That is, the pressure introduction channel (52) is formed by a through hole of a very simple structure. Therefore, according to the present invention, it is possible to provide the single-screw compressor (1) with the pressure introduction channel (52) without complicating the structure of the single-screw compressor (1).

In the third aspect, the pressure introduction channel (52) is opened in a portion of the front surface of each gate (51) that is close to the center of the gate rotor (50). In the fourth aspect, the pressure introduction channel (52) is opened in a portion of the front surface of each gate (51) that is close to the front side in the rotation direction of the gate rotor (50). Therefore, in the third and fourth aspects, the pressure introduction channel (52) opened in the front surface of the gate (51) is brought to a state where it is no longer in communication with the compression chamber (23) at a relatively early point in time during the phase in which the gate (51) comes out of the helical groove (41) of the screw rotor (40).

Here, during the phase in which the gate (51) comes out of the helical groove (41) of the screw rotor (40), only a portion of the gate (51) is inside the helical groove (41) with the remaining portion out of the helical groove (41). That is, for a gate (51) being in that phase, the pressure of the fluid compressed in the compression chamber (23) acts upon a portion of the front surface of the gate (51) while a pressure lower than the fluid pressure in the compression chamber (23) acts upon the remaining portion. Therefore, if one continues to introduce the fluid pressure in the compression chamber (23) to the back surface side of the gate (51) even after the proportion of a portion of the gate (51) that has come off the helical groove (41) has become large, the gate (51) may be pushed and deformed to the front surface side so that the gate (51) comes into contact with the casing (10) adjacent to the screw rotor (40).

In contrast, in the third and fourth aspects, the pressure introduction channel (52) provided in the gate (51) is brought to a state where it is shut off from the compression chamber (23) at a relatively early point in time during the phase in which the gate (51) comes out of the helical groove (41) of the screw rotor (40). Therefore, the pressure of the gap between the back surface of the gate (51) and the gate supporting portion (57) corresponding to the gate (51) is equal to or somewhat lower than the fluid pressure in the compression chamber (23) at a point in time when the pressure introduction channel (52) is shut off from the compression chamber (23). That is, after the pressure introduction channel (52) is shut off from the compression chamber (23), the pressure acting upon the back surface of a portion of the gate (51) that has come off the helical groove (41) of the screw rotor (40) is lower than the fluid pressure in the compression chamber (23) at that point in time.

Therefore, in the third and fourth aspects, it is possible to reduce the deformation to the front surface side of a portion of the gate (51) that has already come off the helical groove (41) during the phase in which the gate (51) comes out of the helical groove (41) of the screw rotor (40), and it is therefore possible to avoid a contact between the gate (51) and the casing (10), etc., and to thereby ensure the reliability of the single-screw compressor (1).

In the fifth aspect, the back pressure space (65), whose periphery is surrounded by the sealing member (66,67), is formed on the back surface side of each gate (51), and the fluid pressure on the front surface side of the gate (51) is introduced into the back pressure space (65). Therefore, in a state where the gate (51) is meshed with the helical groove (41) of the screw rotor (40), a portion of the fluid in the compression chamber (23) located on the front surface side of the gate (51) flows into the back pressure space (65) through the pressure introduction channel (52), but the fluid is prevented by the sealing member (66,67) from flowing out of the back pressure space (65). Therefore, according to this invention, it is possible to keep at a low level the amount of fluid leaking out of the compression chamber (23) through the pressure introduction channel (52) or the back pressure space (65).

In the sixth aspect, the sealing member (66,67) is arranged along the peripheral portion of the gate supporting portion (57), and a large portion of the gap between the gate (51) and the gate supporting portion (57) serves as the back pressure space (65). Therefore, the fluid pressure in the back pressure space (65) can be made to act upon a large portion of the back surface of each gate (51). That is, the fluid pressure acting upon a large portion of the back surface of each gate (51) is generally equal to the fluid pressure acting upon the front surface thereof. Therefore, according to this invention, it is possible to sufficiently reduce the difference between a force that pushes the gate (51) to the back surface side and a force that pushes the gate (51) to the front surface side, and it is possible to reliably reduce the deformation of the gate (51).

Here, during the operation of the single-screw compressor (1), the gate rotor (50) and the gate rotor supporting member (55) thermally expand. In a typical single-screw compressor (1), the material of the gate rotor (50) and the material of the gate rotor supporting member (55) are different from each other and they normally have different coefficients of thermal expansion. Therefore, if the relative movement between the gate rotor (50) and the gate rotor supporting member (55) is unnecessarily restricted, the gate rotor (50) may deform to thereby contact the screw rotor (40) due to the difference therebetween in terms of the amount of thermal deformation.

In contrast, in the seventh aspect, the sealing member (66, 67) is attached to one of the gate (51) and the gate supporting portion (57) and is in contact with the other one of the gate (51) and the gate supporting portion (57). Therefore, the relative movement between the gate rotor (50) and the gate rotor supporting member (55) is not substantially prevented by the sealing member (66,67). Therefore, according to this invention, it is possible to avoid unnecessarily restricting the relative movement between the gate rotor (50) and the gate rotor supporting member (55), and it is therefore possible to avoid a contact between the gate rotor (50) and the screw rotor (40) due to thermal deformation and to reduce the wear of the gates (51).

DESCRIPTION OF EMBODIMENTS

An embodiment of the present invention will now be described with reference to the drawings.

<General Configuration of Single-Screw Compressor>

A single-screw compressor (1) of the present embodiment (hereinafter referred to simply as a screw compressor) is provided in a refrigerant circuit for performing a refrigeration cycle and is for compressing refrigerant.

Figure 1:
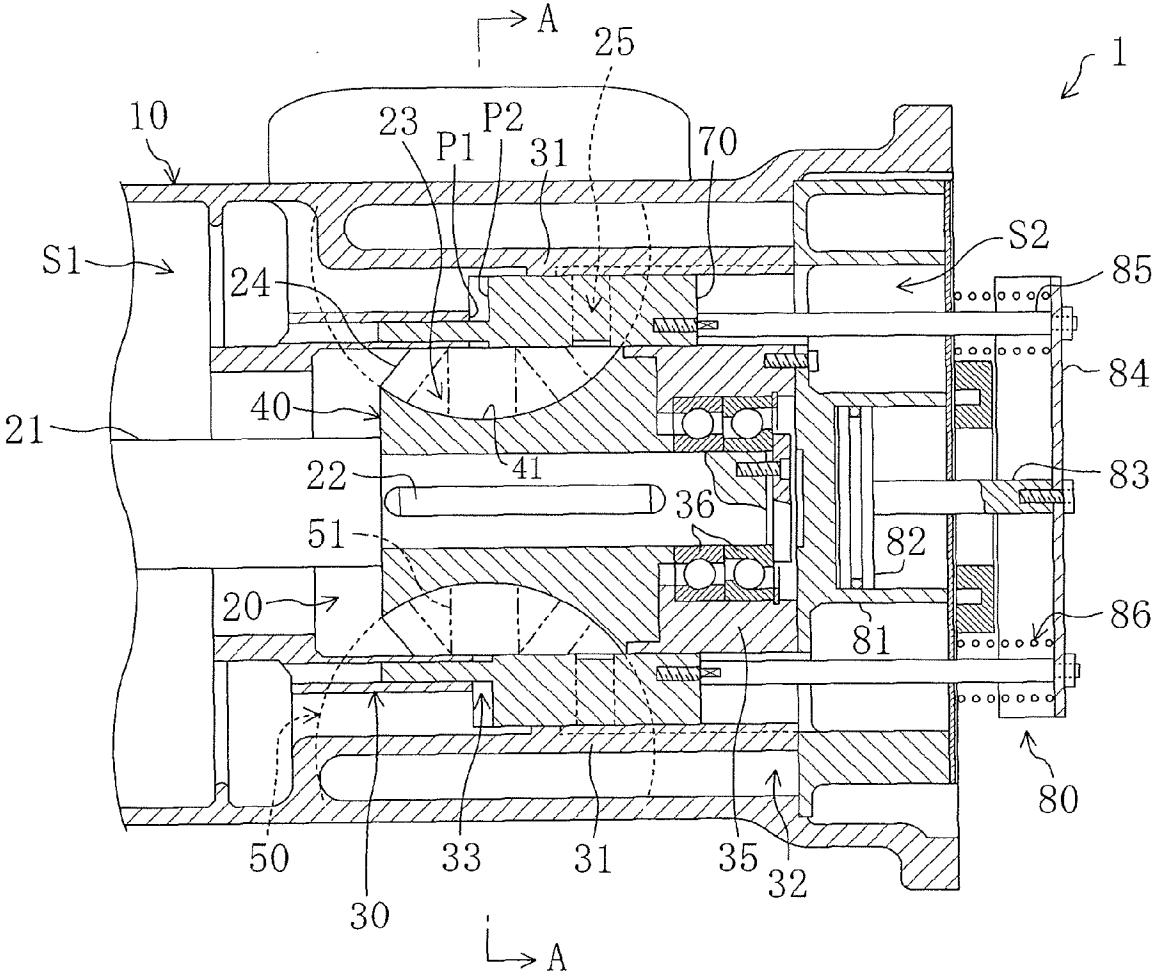
FIG. 1 is a vertical cross-sectional view showing a configuration of a main part of a single-screw compressor.
Figure 2:
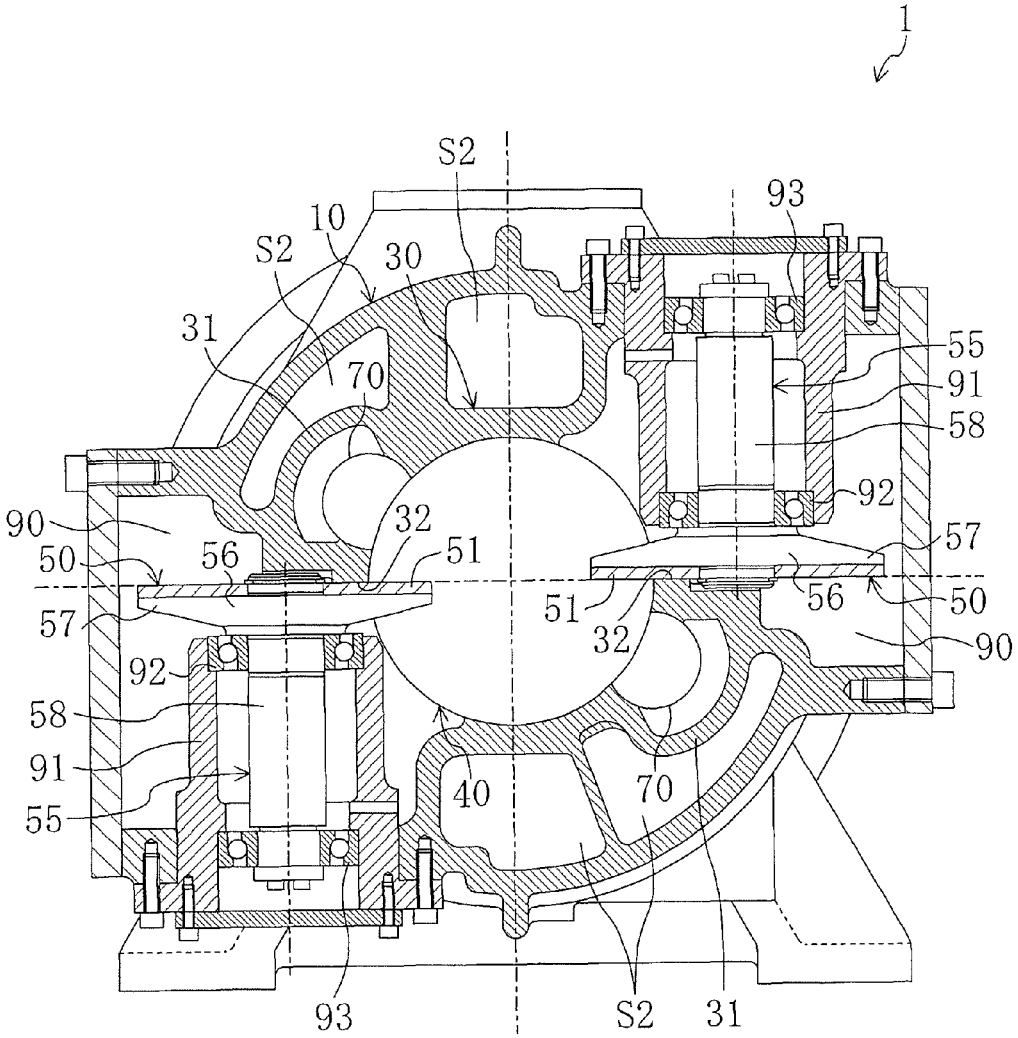
FIG. 2 is a horizontal cross-sectional view showing a cross section taken along A-A in FIG. 1.

As shown in FIG. 1 and FIG. 2, the screw compressor (1) has a semi-hermetic configuration. In the screw compressor (1), a compression mechanism (20) and an electric motor for driving the same are accommodated in one casing (10). The compression mechanism (20) is coupled to the electric motor via a drive shaft (21). In FIG. 1, the electric motor is not shown. Defined in the casing (10) are a low pressure space (S1) into which a low pressure gas refrigerant is introduced from an evaporator of the refrigerant circuit and which guides the low pressure gas into the compression mechanism (20), and a high pressure space (S2) into which the high pressure gas refrigerant discharged from the compression mechanism (20) flows.

The compression mechanism (20) includes a cylindrical wall (30) formed in the casing (10), one screw rotor (40) arranged in the cylindrical wall (30), and two gate rotors (50) meshed with the screw rotor (40). The drive shaft (21) is inserted through the screw rotor (40). The screw rotor (40) and the drive shaft (21) are coupled together by a key (22). The drive shaft (21) is arranged on the same axis with the screw rotor (40). The tip portion of the drive shaft (21) is rotatably supported by a bearing holder (35) located on the high pressure side (on the right side of FIG. 1 where the axial direction of the drive shaft (21) is taken as the left-right direction) of the compression mechanism (20). The bearing holder (35) supports the drive shaft (21) via a ball bearing (36).

Figure 3:
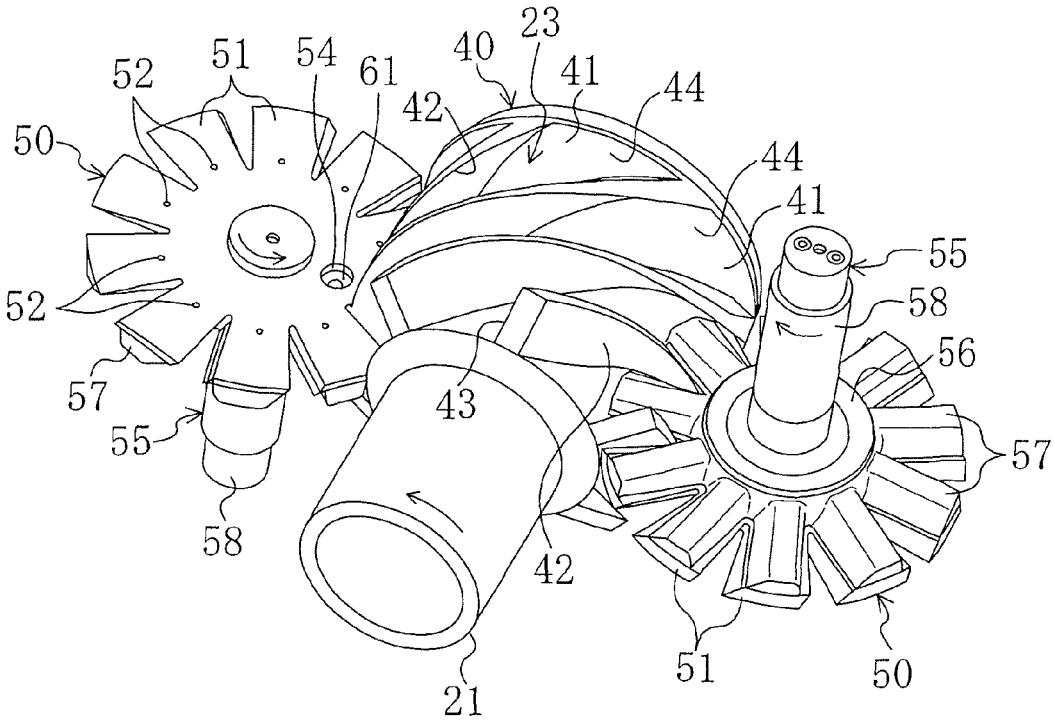
FIG. 3 is a perspective view showing, isolated, a main part of a single-screw compressor.
Figure 4:
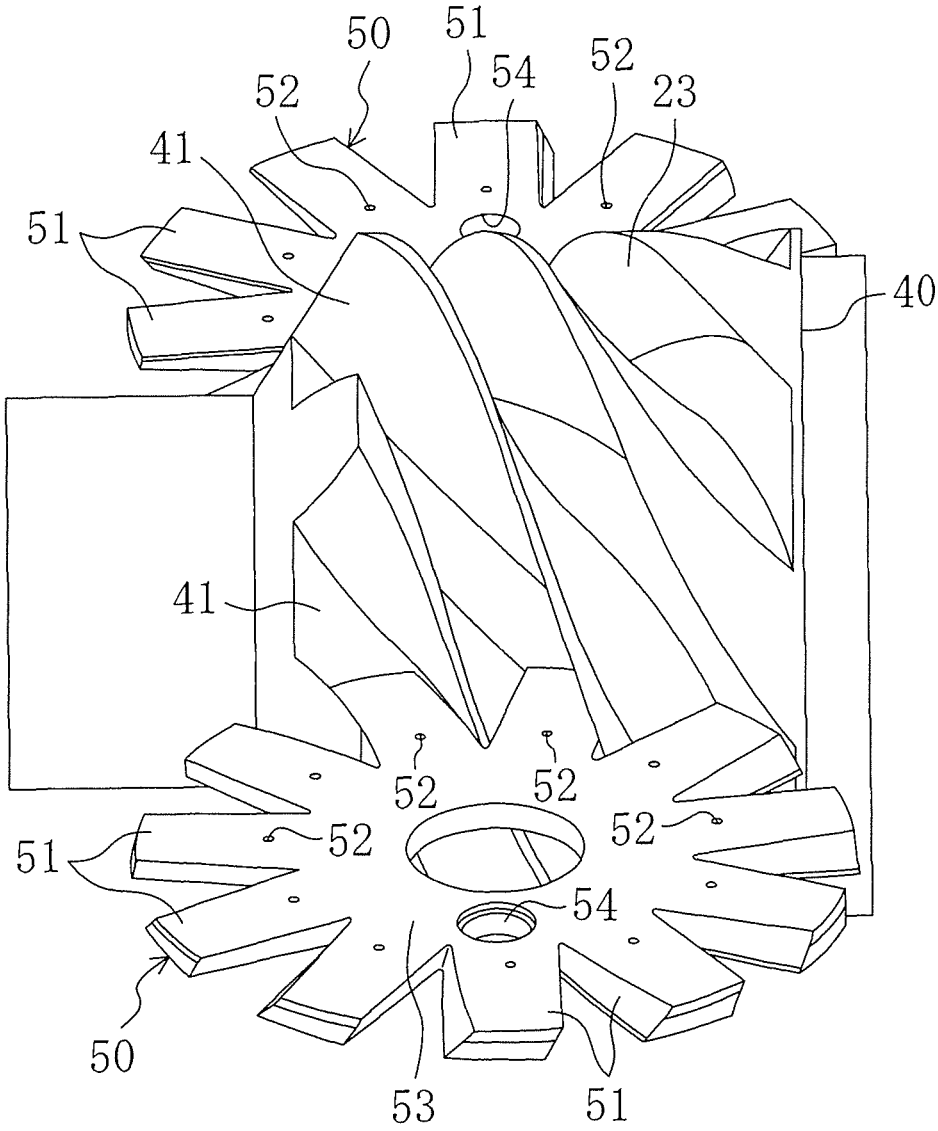
FIG. 4 is a perspective view showing, isolated, a screw rotor and a gate rotor of a single-screw compressor.

As shown in FIG. 3 and FIG. 4, the screw rotor (40) is a metal member formed generally in a cylindrical shape. The screw rotor (40) rotatably fits in the cylindrical wall (30), with the outer circumferential surface thereof sliding against the inner circumferential surface of the cylindrical wall (30). A plurality of (six in the present embodiment) helical grooves (41) are formed so as to extend in a helical pattern from one end of the screw rotor (40) toward the other end thereof on the outer circumferential portion of the screw rotor (40).

The start end of each helical groove (41) of the screw rotor (40) is the left end in FIG. 4, and the terminal end thereof is the right end in the figure. The left end portion in the figure (the suction side end portion) of the screw rotor (40) is tapered. In the screw rotor (40) shown in FIG. 4, the start end of the helical groove (41) is opened at the left end surface of the tapered portion, whereas the terminal end of the helical groove (41) is not opened at the right end surface.

Each gate rotor (50) is a resin member formed in a slightly thicker flat plate shape. Each gate rotor (50) includes a plurality of (eleven in the present embodiment) gates (51) arranged in a radial pattern. The two gate rotors (50) are each attached to a gate rotor supporting member (55) made of a metal (see FIG. 3). The gate rotor supporting member (55) and the gate rotor (50) attached thereto together form a gate rotor assembly (60). The details of the gate rotor assembly (60) will be described later.

The gate rotor supporting member (55) includes a disc portion (56), a gate supporting portion (57), and a shaft portion (58) (see FIG. 3). The disc portion (56) is formed in a slightly thicker disc shape. A number of the gate supporting portions (57), equal to the number of gates (51) of the gate rotor (50), are provided so as to extend radially outwardly from the outer circumferential portion of the disc portion (56). Each gate supporting portion (57) extends along the back surface of the corresponding gate (51) to support the gate (51) from the back surface side thereof. The shaft portion (58) is formed in a round rod shape, and is provided so as to stand on the disc portion (56). The center axis of the shaft portion (58) coincides with the center axis of the disc portion (56). The gate rotor (50) is attached to one surface of the disc portion (56) and the gate supporting portion (57) that is opposite to the shaft portion (58).

The gate rotor assembly (60) is accommodated in a gate rotor chamber (90) defined in the casing (10) (see FIG. 2). Each gate rotor chamber (90) is a space adjacent to the cylindrical wall (30), and is formed on each of the opposing sides of the screw rotor (40) with respect to the rotation axis of the screw rotor (40). Each gate rotor chamber (90) accommodates one gate rotor assembly (60). Each gate rotor chamber (90) is provided with one bearing housing (91). The shaft portion (58) of each rotor supporting member (55) is rotatably supported by a bearing housing (91) in the gate rotor chamber (90) via a ball bearing (92,93). Note that each gate rotor chamber (90) communicates with the low pressure space (S1).

The gate rotor assembly (60) arranged on the right side of the screw rotor (40) in FIG. 2 is provided in such an orientation that the gate rotor (50) is on the lower side (i.e., in such an orientation that the front surface of the gate rotor (50) is facing down). On the other hand, the gate rotor assembly (60) arranged on the left side of the screw rotor (40) in the figure is arranged in such an orientation that the gate rotor (50) is on the upper side (i.e., in such an orientation that the front surface of the gate rotor (50) is facing up). That is, in the casing (10), two gate rotor assemblies (60) are arranged in such orientations that they are axially symmetrical with each other about the rotation axis of the screw rotor (40). The rotation axis of each gate rotor assembly (60) (i.e., the axis of the gate rotor (50) or the shaft portion (58)) is perpendicular to the rotation axis of the screw rotor (40).

In the casing (10), the gate rotor assembly (60) is arranged so that a part of the gate rotor (50) penetrates through the cylindrical wall (30) and some gates (51) are meshed with the helical grooves (41) of the screw rotor (40). Of the cylindrical wall (30) of the casing (10), a wall surface where the gate rotor (50) penetrates therethrough forms a side sealing surface (32) facing the front surface of the gate rotor (50). The side sealing surface (32) is a plane that extends in the axial direction of the screw rotor (40) along the outer circumference of the screw rotor (40). The clearance between the gate rotor (50) and the side sealing surface (32) is set to a very small value (e.g., 40 μm or less).

In the compression mechanism (20), the space limited by the inner circumferential surface of the cylindrical wall (30), the helical grooves (41) of the screw rotor (40), and the gates (51) of the gate rotor (50) serves as a compression chamber (23). The helical grooves (41) of the screw rotor (40) are opened into the low pressure space (S1) at the suction side end portion thereof, and the opening area serves as a suction port (24) of the compression mechanism (20).

The screw compressor (1) includes slide valves (70) as capacity control mechanisms. The slide valves (70) are provided in slide valve accommodating sections (31) which are the cylindrical wall (30) bulging radially outwardly at two locations in the circumferential direction of the cylindrical wall (30). The inner surface of the slide valve (70) forms a part of the inner circumferential surface of the cylindrical wall (30), and the slide valve (70) is slidable in the axial direction of the cylindrical wall (30).

When the slide valve (70) is slid toward the right side of FIG. 1 (toward the right side where the axial direction of the drive shaft (21) is taken as the left-right direction), an axial gap is formed between an end surface (P1) of the slide valve accommodating section (31) and an end surface (P2) of the slide valve (70). This axial gap serves as a bypass passage (33) for returning the refrigerant from the compression chamber (23) into the low pressure space (S1). When the slide valve (70) is moved around to change the degree of the opening of the bypass passage (33), the capacity of the compression mechanism (20) changes. The slide valve (70) includes a discharge port (25) for communicating the compression chamber (23) and the high pressure space (S2) with each other.

The screw compressor (1) includes a slide valve driving mechanism (80) for sliding the slide valve (70). The slide valve driving mechanism (80) includes a cylinder (81) fixed to the bearing holder (35), a piston (82) inserted in the cylinder (81), and an arm (84) connected to a piston rod (83) of the piston (82), a connection rod (85) for connecting together the arm (84) and the slide valve (70), and a spring (86) for urging the arm (84) to the right in FIG. 1 (in such a direction that the arm (84) is pulled away from the casing (10)).

With the slide valve driving mechanism (80) shown in FIG. 1, the inner pressure of the space on the left of the piston (82) (the space on one side of the piston (82) that is closer to the screw rotor (40)) is higher than the inner pressure of the space on the right of the piston (82) (the space on one side of the piston (82)) that is closer to the arm (84)). The slide valve driving mechanism (80) is configured so that the position of the slide valve (70) is adjusted by adjusting the inner pressure of the space on the right of the piston (82) (that is, the gas pressure in the right side space).

During the operation of the screw compressor (1), the suction pressure of the compression mechanism (20) acts on one end surface of the slide valve (70) in the axial direction, and the discharge pressure of the compression mechanism (20) acts on the other end surface thereof. Therefore, during the operation of the screw compressor (1), there is always a force acting on the slide valve (70) in such a direction as to push the slide valve (70) toward the low pressure space (S1). Therefore, if one changes the inner pressure of the space on the left and the inner pressure of the space on the right of the piston (82) in the slide valve driving mechanism (80), it changes the magnitude of the force in such a direction as to pull back the slide valve (70) toward the high pressure space (S2), thereby changing the position of the slide valve (70).

<Configuration of Gate Rotor Assembly>

The detailed configuration of the gate rotor assembly (60) will be described with reference to FIGS. 3 and 5-7.

Figure 5:
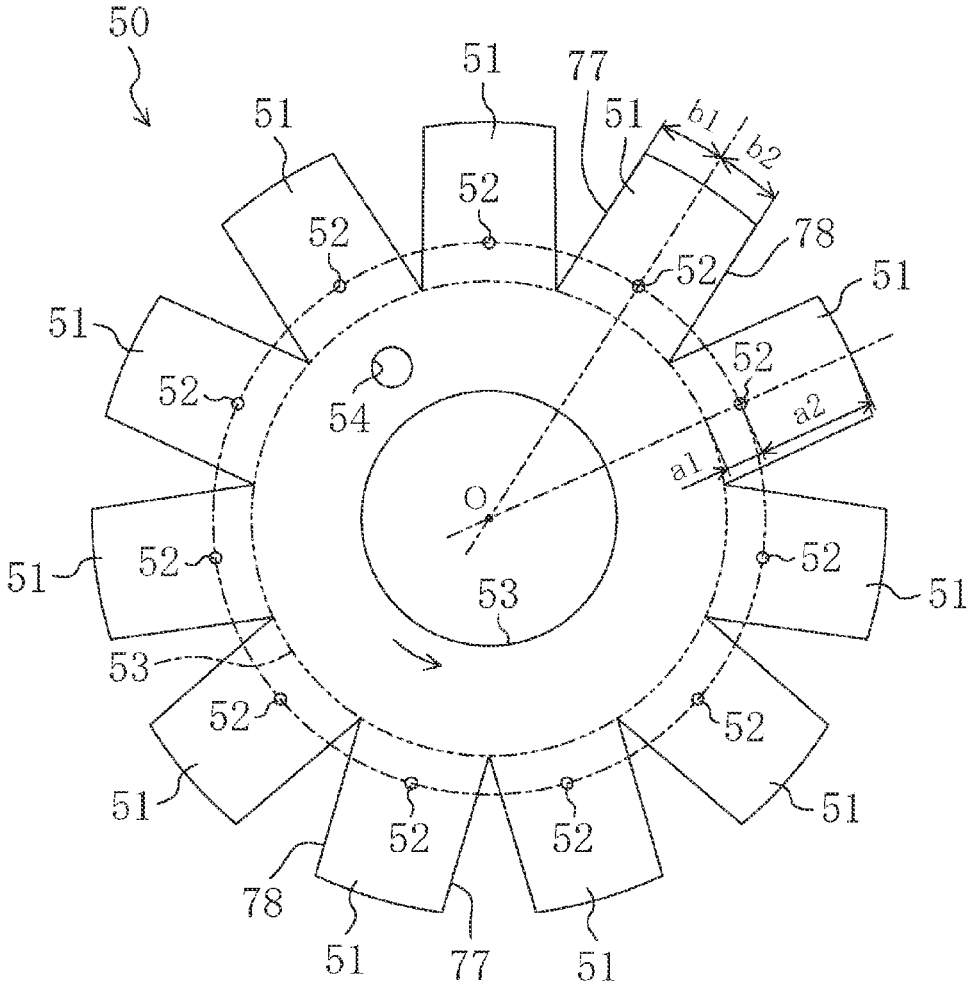
FIG. 5 is a plan view of a gate rotor.

As described above, the gate rotor (50) includes eleven gates (51) arranged in a radial pattern (see FIG. 5). Specifically, the gate rotor (50) includes one base portion (53) and eleven gates (51). The base portion (53) is formed in a wide, flattened ring shape (or a flattened donut shape), and is arranged in a central portion of the gate rotor (50). Each gate (51) is formed generally in a rectangular plate shape, and extends outwardly in the radial direction of the base portion (53) from the periphery of the base portion (53). The eleven gates (51) are arranged equi-angularly in the circumferential direction of the gate rotor (50).

One pin hole (54) is formed in the base portion (53) of the gate rotor (50). The pin hole (54) is a through hole running through the base portion (53) in the thickness direction thereof. The pin hole (54) is a hole through which a fixing pin (61) to be described later is inserted.

Each gate (51) of the gate rotor (50) includes one pressure introduction channel (52). That is, the gate rotor (50) includes a number of the pressure introduction channels (52), equal to the number of the gates (51). Each pressure introduction channel (52) is a through hole running through the gate (51) in the thickness direction thereof. Therefore, each pressure introduction channel (52) extends from a front surface (75) to a back surface (76) of each gate (51) as seen in FIGS. 7, 13 and 16-18. In addition, each gate (51) includes a front edge (77) and a rear edge 78) in the rotational direction of the gate rotor (50) as seen in FIGS. 5-6 and 14-15. The diameter of the pressure introduction channel (52) is about 2 mm, for example.

The gate rotor (50) includes eleven pressure introduction channels (52) arranged along the same pitch circle. On the front surface of each gate (51), the pressure introduction channel (52) is opened in an area close to the proximal end of the gate (51) (i.e., close to the center of the gate rotor (50)).

Specifically, on the front surface of each gate (51), the pressure introduction channel (52) is opened in an area closer to the proximal end of the gate (51) with respect to the center of the gate (51) in the length direction (i.e., the radial direction of the gate rotor (50)). That is, on the front surface of each gate (51), the distance a1 from the outer periphery of the base portion (53) to the center of the pressure introduction channel (52) is shorter than the distance a2 from the center of the pressure introduction channel (52) to the distal end of the gate (51) (i.e., the outer periphery of the gate rotor (50)). On the front surface of each gate (51), the pressure introduction channel (52) is opened at the center of the gate (51) in the width direction (i.e., the circumferential direction of the gate rotor (50)). That is, on the front surface of each gate (51), the distance b1 along the pitch circle from the center of the pressure introduction channel (52) to the front edge of the gate (51) (i.e., the front edge portion in the rotation direction of the gate rotor (50)) is equal to the distance b2 along the pitch circle from the center of the pressure introduction channel (52) to the rear edge of the gate (51) (i.e., the rear edge portion in the rotation direction of the gate rotor (50)). Note that the point O shown in FIG. 5 is the center of the gate rotor (50).

As described above, the gate rotor (50) is attached to the gate rotor supporting member (55). Specifically, one end of the shaft portion (58) of the gate rotor supporting member (55) is inserted in the base portion (53) of the gate rotor (50). The fixing pin (61) is inserted in the pin hole (54) of the gate rotor (50). The distal end of the fixing pin (61) is fixed to the disc portion (56) of the gate rotor supporting member (55). With the shaft portion (58) fitted in the base portion (53) of the gate rotor (50), and with the fixing pin (61) inserted in the pin hole (54) of the gate rotor (50), the relative movement of the gate rotor (50) with respect to the gate rotor supporting member (55) is restricted.

Note however that in the gate rotor assembly (60), the relative movement of the gate rotor (50) with respect to the gate rotor supporting member (55) is not completely prohibited. The reason will be described. While the gate rotor (50) and the gate rotor supporting member (55) thermally expand during the operation of the screw compressor (1), the gate rotor (50) which is made of a resin and the gate rotor supporting member (55) which is made of a metal have different coefficients of thermal expansion from each other. Therefore, if the relative movement between the gate rotor (50) and the gate rotor supporting member (55) is completely prohibited, the gate rotor (50) may deform to thereby contact the screw rotor (40) due to the difference therebetween in terms of the amount of thermal deformation. In view of this, in the gate rotor assembly (60), the relative rotation of the gate rotor (50) with respect to the gate rotor supporting member (55) is allowed though only slightly.

Figure 6:
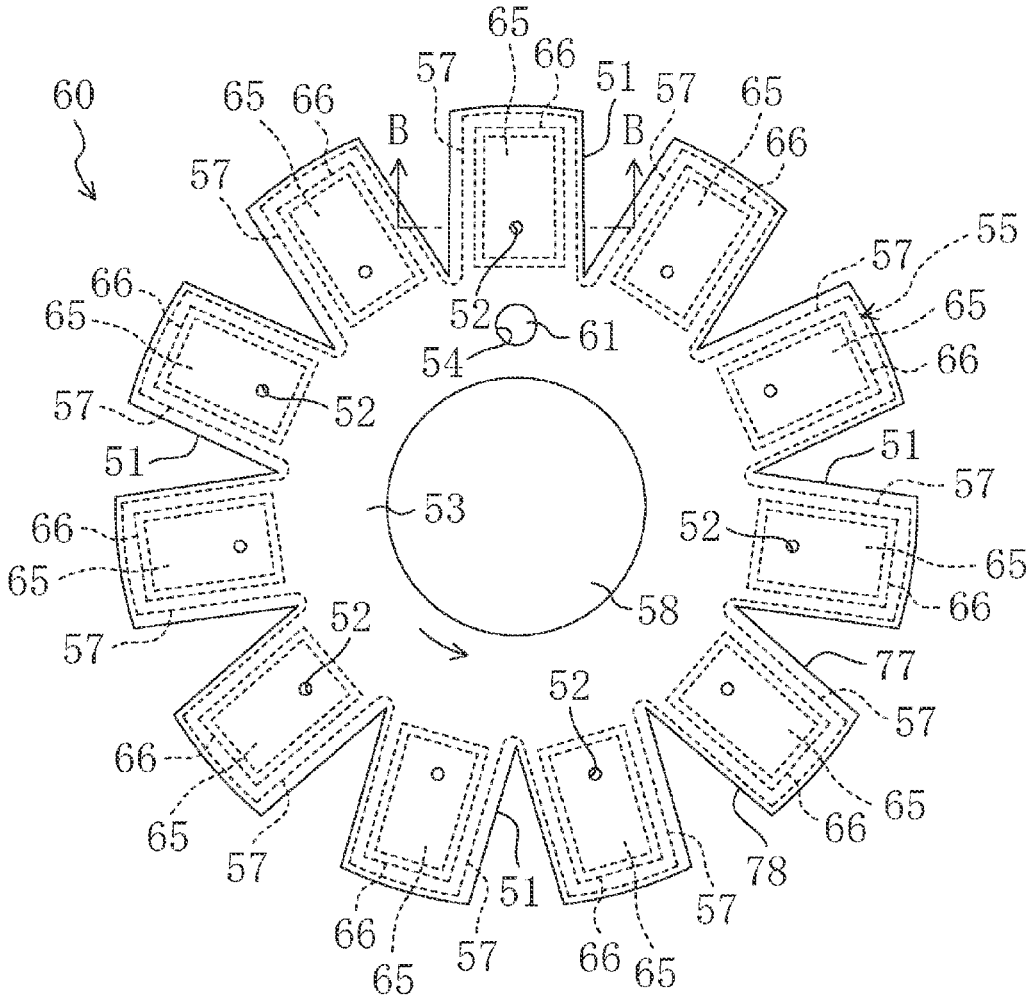
FIG. 6 is a plan view showing a gate rotor of a gate rotor assembly as viewed from the front surface side.

As shown in FIG. 6, in the gate rotor assembly (60), one gate supporting portion (57) is arranged on the back surface side of each gate (51). The front surface of each gate supporting portion (57) (i.e., the surface facing the back surface of the gate (51)) has a shape corresponding to the shape of the back surface of the gate (51), and covers generally the entire back surface of the gate (51).

Figure 7:
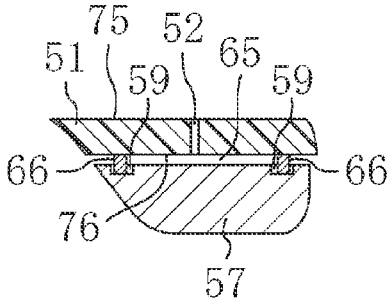
FIG. 7 is a cross-sectional view showing a cross section taken along B-B in FIG. 6.

As shown in FIG. 7, in the gate rotor assembly (60), a sealing ring (66) which is a sealing member is provided between the gate (51) and the gate supporting portion (57). The sealing ring (66) is a member formed in a rectangular frame shape that is slightly smaller than the front surface of the gate supporting portion (57). The material of the sealing ring (66) may be a resin such as a fluoropolymer resin, or a rubber such as a fluoroelastomer. Note that a rubber O-ring may be used instead of the sealing ring (66).

One sealing ring (66) is provided on the back surface side of each gate (51). Specifically, the sealing ring (66) is fitted in a depressed groove (59) formed in the front surface of the gate supporting portion (57). The depth of the depressed groove (59) is less than the height of the sealing ring (66). Therefore, the sealing ring (66) protrudes out of the front surface of the gate supporting portion (57) to be in contact with the back surface of the gate (51). The sealing ring (66) is fitted in the depressed groove (59) of the gate supporting portion (57) so as to be in contact with the gate (51), thereby sealing the periphery of a back pressure space (65) to be described later.

In the gate rotor assembly (60), a gap is formed between the back surface of the gate (51) and the front surface of the gate supporting portion (57), and a portion of the gap inside the sealing ring (66) (i.e., a portion surrounded by the sealing ring (66)) serves as the back pressure space (65). One back pressure space (65) is formed on the back surface side of each gate (51), and communicates with the pressure introduction channel (52) formed in the corresponding gate (51).

As described above, the sealing ring (66) is formed in a rectangular frame shape that is slightly smaller than the front surface of the gate supporting portion (57). That is, on the back surface side of each gate (51), the sealing ring (66) is arranged along the periphery of the gate supporting portion (57) facing the gate (51). Therefore, the most part of the gap formed between the back surface of the gate (51) and the front surface of the gate supporting portion (57) serves as the back pressure space (65) surrounded by the sealing ring (66), with the most part of the back surface of the gate (51) facing the back pressure space (65).

-Operation-

An operation of the screw compressor (1) of the present embodiment will be described.

Figure 8:
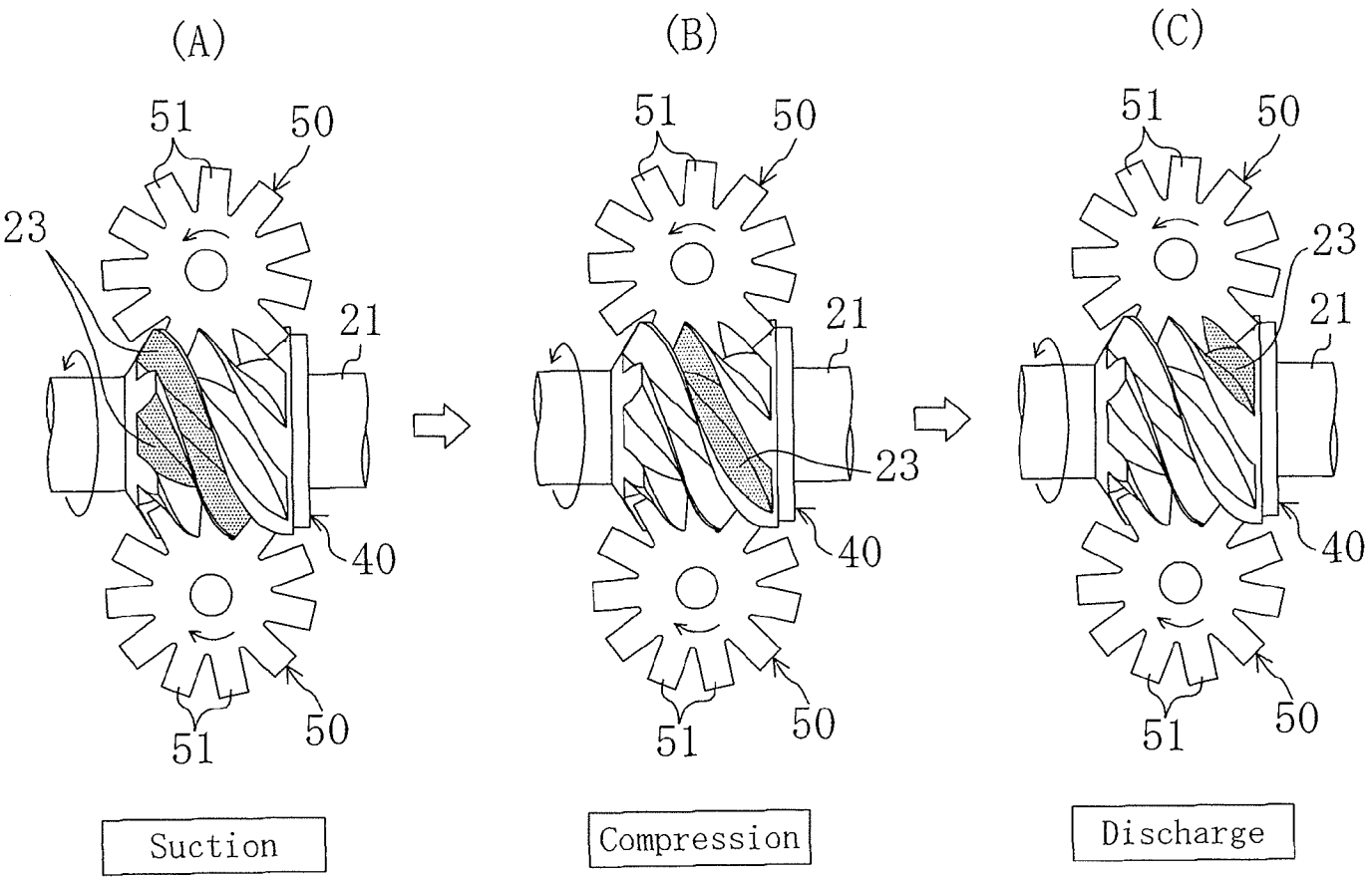
FIG. 8 shows plan views showing operations of a compression mechanism of a single-screw compressor, wherein (A) shows a suction phase, (B) shows a compression phase, and (C) shows a discharge phase.

When the electric motor is started in the screw compressor (1), the screw rotor (40) rotates, following the rotation of the drive shaft (21). The gate rotor (50) also rotates, following the rotation of the screw rotor (40), and the compression mechanism (20) repeats the suction phase, the compression phase, and the discharge phase. Here, the description will be made with a particular attention to the compression chamber (23) dotted in FIG. 8.

In FIG. 8(A), the dotted compression chamber (23) communicates with the low pressure space (S1). The helical groove (41) in which the compression chamber (23) is formed is meshed with the gate (51) of the gate rotor (50) located on the lower side of the figure. When the screw rotor (40) rotates, the gate (51) relatively moves toward the terminal end of the helical groove (41), and the volume of the compression chamber (23) increases accordingly. As a result, the low pressure gas refrigerant of the low pressure space (S1) is sucked into the compression chamber (23) through the suction port (24).

When the screw rotor (40) further rotates, it will be in a state of FIG. 8(B). In this figure, the dotted compression chamber (23) is in a closed state. That is, the helical groove (41) in which the compression chamber (23) is formed is meshed with the gate (51) of the gate rotor (50) located on the upper side of the figure, and is partitioned from the low pressure space (S1) by the gate (51). Then, as the gate (51) moves toward the terminal end of the helical groove (41), following the rotation of the screw rotor (40), the volume of the compression chamber (23) gradually decreases. As a result, the gas refrigerant in the compression chamber (23) is compressed.

When the screw rotor (40) further rotates, it will be in a state of FIG. 8(C). In the figure, the dotted compression chamber (23) is in a state where it communicates with the high pressure space (S2) via the discharge port (25). Then, as the gate (51) moves toward the terminal end of the helical groove (41), following the rotation of the screw rotor (40), the compressed refrigerant gas is pushed out into the high pressure space (S2) from the compression chamber (23).

As described above, in the gate rotor assembly (60) of the present embodiment, the pressure introduction channel (52) is formed in each gate (51), and the back pressure space (65) which communicates with the pressure introduction channel (52) is formed on the back surface side of each gate (51). Therefore, in the screw compressor (1) of the present embodiment, the deformation of each gate (51) meshed with a helical groove (41) of the screw rotor (40) is reduced. This will be described below while focusing on a single gate (51*a*) shown in FIGS. 9-12.

Figure 9:
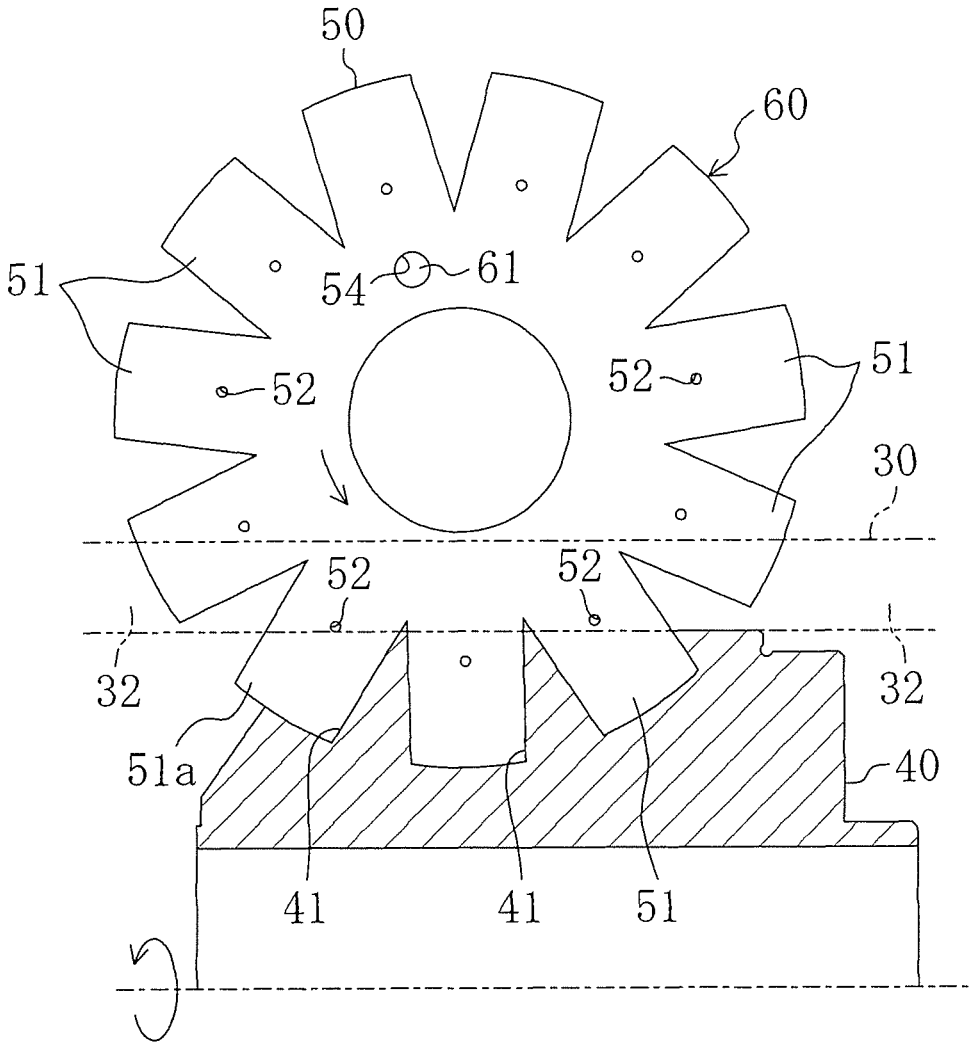
FIG. 9 is a schematic cross-sectional view showing a horizontal cross section of a main part of a single-screw compressor.

FIG. 9 shows a state immediately before the pressure introduction channel (52) formed in the gate (51*a*) communicates with the compression chamber (23). That is, in this state, the pressure introduction channel (52) of the gate (51*a*) is completely covered by the side sealing surface (32) of the cylindrical wall (30).

Since the gate rotor chamber (90) communicates with the low pressure space (S1), the pressure of the gap between the front surface of the gate (51*a*) and the side sealing surface (32) is generally equal to the refrigerant pressure in the low pressure space (S1). The back pressure space (65) formed on the back surface of the gate (51*a*) communicates with the gap between the front surface of the gate (51*a*) and the side sealing surface (32) via the pressure introduction channel (52). Therefore, the pressure of the back pressure space (65) foamed on the back surface side of the gate (51*a*) is also generally equal to the refrigerant pressure in the low pressure space (S1), and in the state shown in FIG. 9, the compression chamber (23) on the front surface side of the gate (51*a*) is not yet in a closed state but communicates with the low pressure space (S1). Therefore, the pressure of the back pressure space (65) facing the back surface of the gate (51*a*) is substantially equal to the refrigerant pressure acting upon the front surface of the gate (51*a*), and a force that pushes the gate (51*a*) to the back surface side and a force that pushes the gate (51*a*) to the front surface side are equal to each other.

As the gate rotor (50) rotates from the state shown in FIG. 9, the gate (51*a*) moves toward the terminal end of the helical groove (41) of the screw rotor (40), and the compression chamber (23) on the front surface side of the gate (51*a*) is brought to a closed state. Then, as the gate rotor (50) further rotates, the refrigerant is compressed in the compression chamber (23) on the front surface side of the gate (51*a*), thereby gradually increasing the internal pressure of the compression chamber (23).

Figure 10:
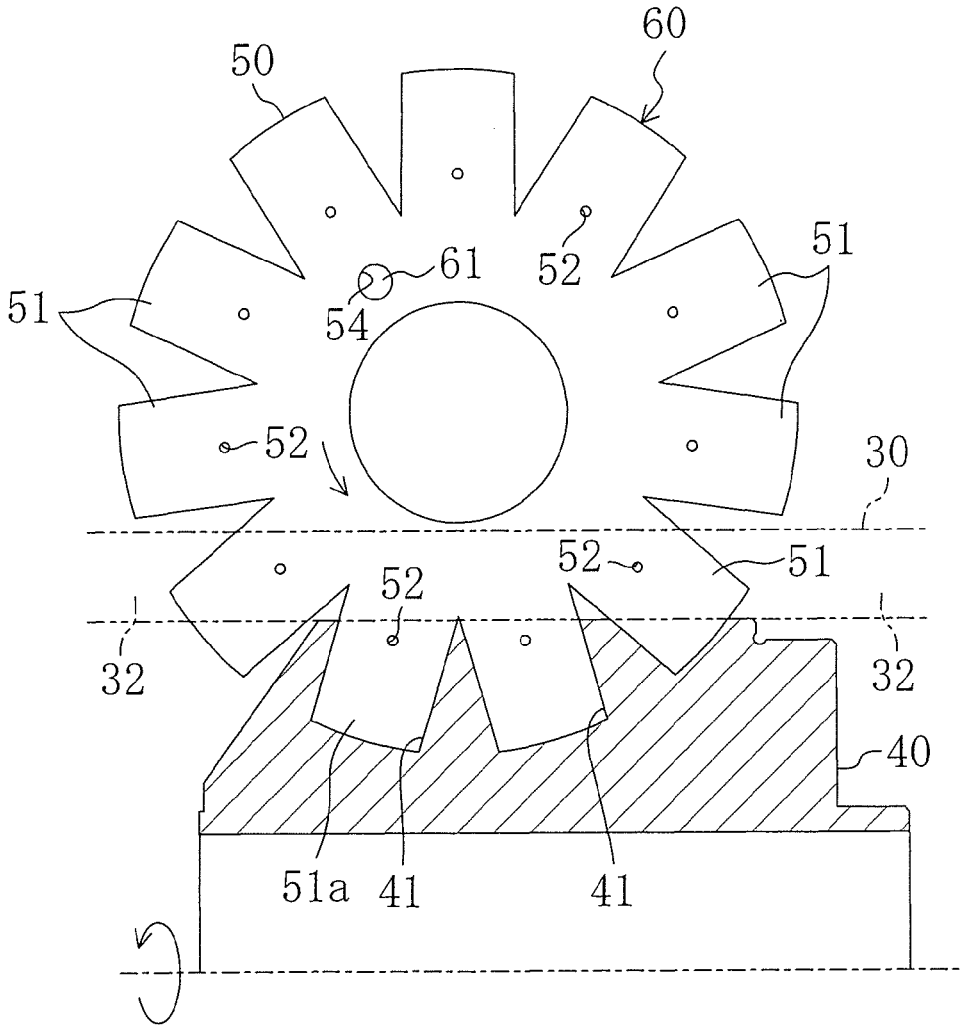
FIG. 10 is a schematic cross-sectional view showing a horizontal cross section of the main part of the single-screw compressor.

FIG. 10 shows a state where the gate rotor (50) has somewhat rotated from the point in time when the compression chamber (23) on the front surface side of the gate (51*a*) is brought to a closed state. In this state, the internal pressure of the compression chamber (23) on the front surface side of the gate (51*a*) is higher than the refrigerant pressure in the low pressure space (S1). On the other hand, in this state, the pressure introduction channel (52) formed in the gate (51*a*) has come off the side sealing surface (32) to communicate with the compression chamber (23). Therefore, the internal pressure of the compression chamber (23) facing the front surface of the gate (51*a*) is introduced to the back pressure space (65) on the back surface side of the gate (51*a*) via the pressure introduction channel (52), and the internal pressure of the back pressure space (65) becomes substantially equal to the internal pressure of the compression chamber (23). The periphery of the back pressure space (65) is sealed by the sealing ring (66), and there is substantially no leakage of refrigerant from the back pressure space (65) on the back surface side of the gate (51*a*) to the outside.

Therefore, also in the state shown in FIG. 10, the pressure of the back pressure space (65) facing the back surface of the gate (51*a*) is substantially equal to the refrigerant pressure acting upon the front surface of the gate (51*a*), and a force that pushes the gate (51*a*) to the back surface side and a force that pushes the gate (51*a*) to the front surface side are equal to each other. Therefore, it is possible to reduce the deformation of the gate (51*a*) due to the refrigerant pressure in the compression chamber (23) acting upon the front surface of the gate (51*a*), even in the phase where the compression chamber (23) facing the front surface of the gate (51*a*) is in a closed state and the refrigerant is compressed in the compression chamber (23).

As the gate rotor (50) rotates from the state shown in FIG. 10, the compression chamber (23) facing the front surface of the gate (51*a*) gradually elevates, and then the compression chamber (23) communicates with the discharge port (25), thereby discharging the compressed refrigerant in the compression chamber (23) to the discharge port (25). During this period, the internal pressure is kept high in the compression chamber (23) on the front surface side of the gate (51*a*), while the gate (51*a*) comes off the helical groove (41) of the screw rotor (40) to increase the proportion of the portion of the gate (51*a*) that faces the side sealing surface (32).

The side sealing surface (32) is located between the compression chamber (23) in the compression phase or the discharge phase and the gate rotor chamber (90). Since the internal pressure of the gate rotor chamber (90) is generally equal to the internal pressure of the low pressure space (S1), the pressure of the gap between the front surface of the gate (51*a*) and the side sealing surface (32) is lower than the internal pressure of the compression chamber (23) in the latter half of the compression phase or in the discharge phase. The pressure of the gap between the front surface of the gate (51*a*) and the side sealing surface (32) is lower at locations closer to the gate rotor chamber (90). Therefore, if one continues to introduce the refrigerant pressure in the compression chamber (23) into the back pressure space (65) on the back surface side of the gate (51*a*) even after the proportion of a portion of the gate (51*a*) that has come off the helical groove (41) of the screw rotor (40) has become large, the gate (51*a*) may deform by expanding to the front surface side to thereby come into contact with the side sealing surface (32).

Figure 11:
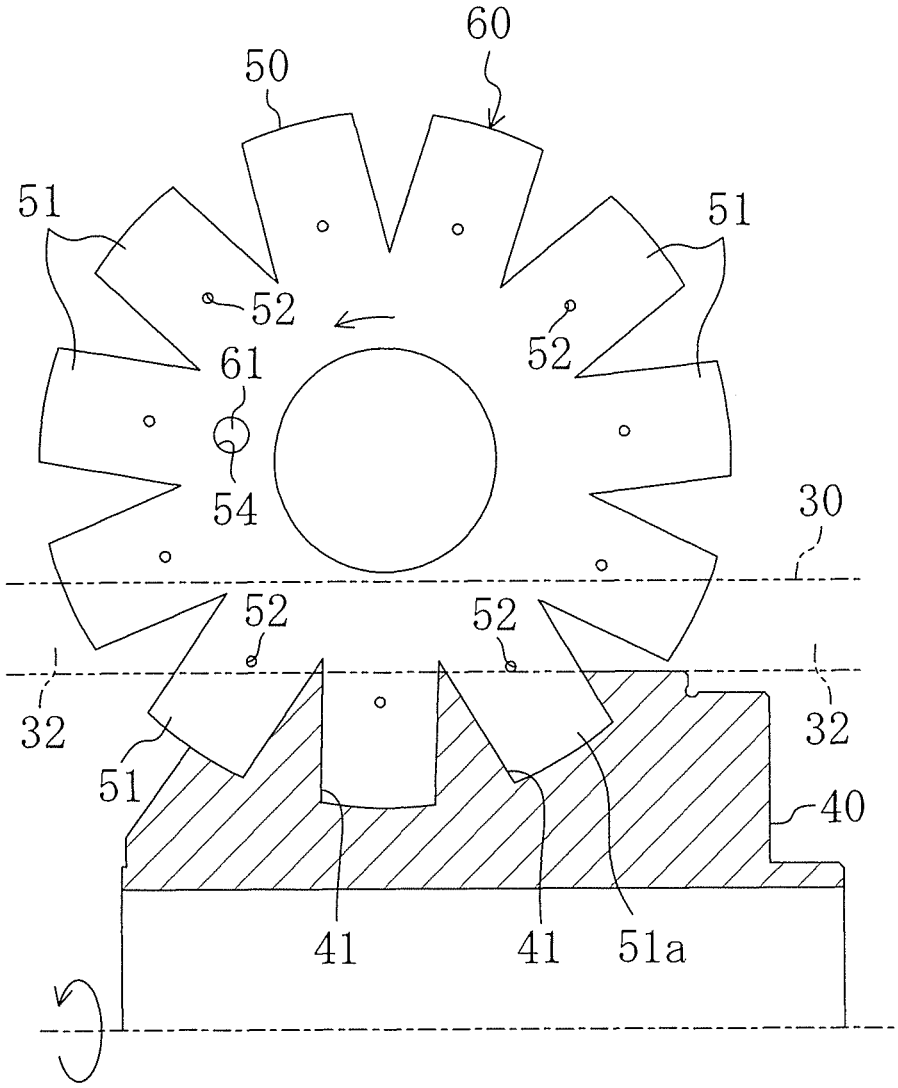
FIG. 11 is a schematic cross-sectional view showing a horizontal cross section of the main part of the single-screw compressor.

In view of this, in the gate rotor assembly (60) of the present embodiment, the pressure introduction channel (52) is formed close to the proximal end of the gate (51*a*). Therefore, as shown in FIG. 11, the pressure introduction channel (52) formed in the gate (51*a*) is shut off from the compression chamber (23) before the proportion of a portion of the gate (51*a*) that has come off the helical groove (41) to face the side sealing surface (32) becomes excessive. Note that FIG. 11 shows a state immediately after the pressure introduction channel (52) formed in the gate (51*a*) is covered by the side sealing surface (32) and completely shut off from the compression chamber (23).

Even after the pressure introduction channel (52) of the gate (51*a*) is completely shut off from the compression chamber (23), the refrigerant pressure in the compression chamber (23) in the latter half of the compression phase or in the discharge phase continues to act upon a portion of the front surface of the gate (51*a*). On the other hand, the pressure introduction channel (52) of the gate (51*a*) is covered by the side sealing surface (32) for a while after being shut off from the compression chamber (23). Therefore, even after the pressure introduction channel (52) of the gate (51*a*) is shut off from the compression chamber (23), the internal pressure of the back pressure space (65) on the back surface side of the gate (51*a*) does not rapidly decrease to be around the internal pressure of the gate rotor chamber (90) though it does decrease to some degree.

Figure 12:
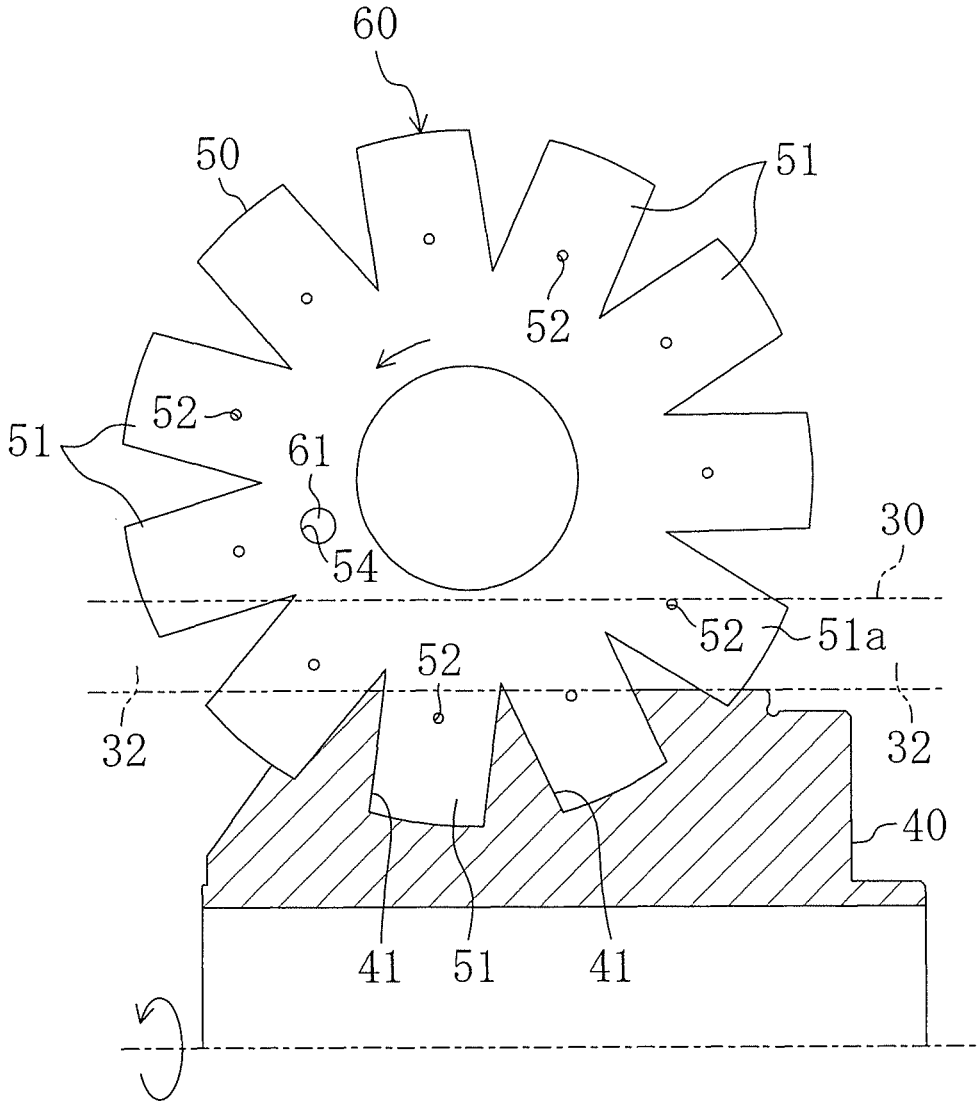
FIG. 12 is a schematic cross-sectional view showing a horizontal cross section of the main part of the single-screw compressor.

That is, during a period in which the pressure introduction channel (52) of the gate (51*a*) is covered by the side sealing surface (32) (i.e., a period from the state shown in FIG. 11 to the state shown in FIG. 12), the internal pressure of the back pressure space (65) on the back surface side of the gate (51*a*) is higher than the internal pressure of the gate rotor chamber (90) (i.e., the internal pressure of the low pressure space (S1)). Note that FIG. 12 shows a state immediately before the pressure introduction channel (52) formed in the gate (51*a*) comes off the side sealing surface (32) to communicate with the gate rotor chamber (90).

Therefore, even after the pressure introduction channel (52) of the gate (51*a*) is completely shut off from the compression chamber (23), the difference between a force that pushes the gate (51*a*) to the back surface side and a force that pushes the gate (51*a*) to the front surface side is smaller as compared with that with a conventional screw compressor where the internal pressure of the gate rotor chamber constantly acts upon the back surface of the gate, thus achieving a smaller amount of deformation of the gate (51*a*). When the gate rotor (50) rotates from the state shown in FIG. 12, the pressure introduction channel (52) formed in the gate (51*a*) opens into the gate rotor chamber (90) so that the internal pressure of the back pressure space (65) on the back surface side of the gate (51*a*) is generally equal to the internal pressure of the gate rotor chamber (90). At this point in time, the gate (51*a*) has come substantially entirely off the helical groove (41) of the screw rotor (40).

-Advantages Of Embodiment-

In the screw compressor (1) of the present embodiment, the gate rotor assembly (60) is provided with the pressure introduction channel (52) so that the fluid pressure on the front surface side of each gate (51) is introduced into the back pressure space (65) formed between the gate (51) and the corresponding gate supporting portion (57) via the pressure introduction channel (52). Therefore, for each gate (51) of the gate rotor (50), the difference between a force that pushes the gate (51) to the back surface side and a force that pushes the gate (51) to the front surface side is reduced. This as a result reduces the deformation of the gate (51) due to the refrigerant pressure in the compression chamber (23) acting thereupon, and reduces the wear of the gate (51) due to the gate (51) deformed to come into direct contact with the screw rotor (40).

Therefore, according to the present embodiment, it is possible to reduce the wear of the gates (51) during the operation of the screw compressor (1), and it is possible to keep the hermeticity of the compression chamber (23) at a high level over a long period of time. As a result, it is possible to reduce the decrease in the performance of the screw compressor (1) for an increase in the operation time, and it is possible to improve the reliability of the screw compressor (1).

If a gate (51) meshed with a helical groove (41) of the screw rotor (40) deforms, the clearance between the wall surface of the helical groove (41) and the peripheral portion of the gate (51) increases, which may lower the hermeticity of the compression chamber (23). In contrast, according to the present embodiment, the amount of deformation of the gate (51) meshed with the helical groove (41) of the screw rotor (40) is reduced, and it is therefore possible to maintain, at a predetermined value, the clearance between the wall surface of the helical groove (41) and the peripheral portion of the gate (51). Therefore, it is possible to keep the hermeticity of the compression chamber (23) at a high level and to keep at a low level the amount of refrigerant leaking out of the compression chamber (23) in the compression phase, thus improving the performance of the screw compressor (1).

In the gate rotor assembly (60) of the present embodiment, the pressure introduction channel (52) is opened in a portion on the front surface of each gate (51) that is close to the proximal end. Therefore, the pressure introduction channel (52) of a gate (51) meshed with a helical groove (41) of the screw rotor (40) is shut off from the compression chamber (23) before the proportion of a portion of the gate (51) that has come off the helical groove (41) to face the side sealing surface (32) becomes excessive. Therefore, according to the present embodiment, it is possible to avoid the phenomenon that the gate (51) is deformed by receiving the internal pressure of the back pressure space (65) to thereby come into contact with the side sealing surface (32), and it is therefore possible to prevent the wear of the gate (51) due to contact with the side sealing surface (32), thus ensuring the reliability of the screw compressor (1).

In the gate rotor assembly (60) of the present embodiment, the periphery of the back pressure space (65) formed on the back surface side of each gate (51) is sealed by the sealing ring (66). Therefore, in a state where a gate (51) is meshed with a helical groove (41) of the screw rotor (40), a portion of the refrigerant in the compression chamber (23) located on the front surface side of the gate (51) flows into the back pressure space (65) through the pressure introduction channel (52), but the refrigerant is prevented from flowing out of the back pressure space (65) by means of the sealing ring (66). Therefore, according to the present embodiment, it is possible to keep at a low level the amount of refrigerant leaking out of the compression chamber (23) through the pressure introduction channel (52) or the back pressure space (65).

In the gate rotor assembly (60) of the present embodiment, the sealing ring (66) is arranged along the peripheral portion of the gate supporting portion (57), and the large portion of the gap between the gate (51) and the gate supporting portion (57) serves as the back pressure space (65). Therefore, the internal pressure of the back pressure space (65) can be made to act upon a large portion of the back surface of each gate (51). That is, on the back surface of each gate (51), the refrigerant pressure acting upon a large portion thereof is generally equal to the refrigerant pressure acting upon the front surface thereof. Therefore, according to the present embodiment, it is possible to sufficiently reduce the difference between a force that pushes the gate (51) to the back surface side and a force that pushes the gate (51) to the front surface side, and it is possible to reliably reduce the deformation of the gate (51).

Here, the gate rotor (50) made of a resin and the gate rotor supporting member (55) made of a metal have different coefficients of thermal expansion. Therefore, in order to prevent the bending of the gate rotor (50) due to their amounts of thermal deformation, the relative rotation of the gate rotor (50) with respect to the gate rotor supporting member (55) is allowed though only slightly. This is as described above.

On the other hand, in the gate rotor assembly (60) of the present embodiment, while the sealing ring (66) is fitted in the depressed groove (59) formed in the front surface of the gate supporting portion (57), it is merely in contact with the back surface of the gate (51). Therefore, the relative rotation between the gate rotor (50) and the gate rotor supporting member (55) is not substantially prevented by the sealing ring (66). Therefore, according to the present embodiment, it is possible to avoid unnecessarily restricting the relative movement between the gate rotor (50) and the gate rotor supporting member (55), and it is therefore possible to avoid a contact between the gate rotor (50) and the screw rotor (40) due to thermal deformation and to reduce the wear of the gates (51).

-Variation 1 of Embodiment-

Figure 13:
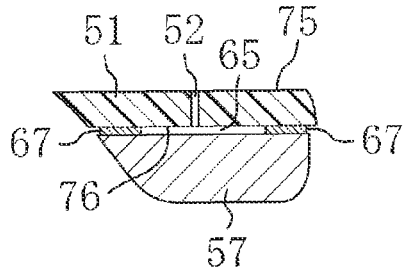
FIG. 13 is similar to FIG. 7, showing a gate rotor assembly according to Variation 1 of an embodiment.

In the gate rotor assembly (60) of the present embodiment, the back pressure space (65) may be formed on the back surface side of each gate (51) by sandwiching a gasket (67) between the gate (51) and the gate supporting portion (57), as shown in FIG. 13. The back pressure space (65) of this variation has its periphery surrounded by the gasket (67) as a sealing member.

-Variation 2 of Embodiment-

In the gate rotor assembly (60) of the present embodiment, the opening position of the pressure introduction channel (52) on the front surface of each gate (51) is not limited to the position shown in FIG. 5.

Figure 14:
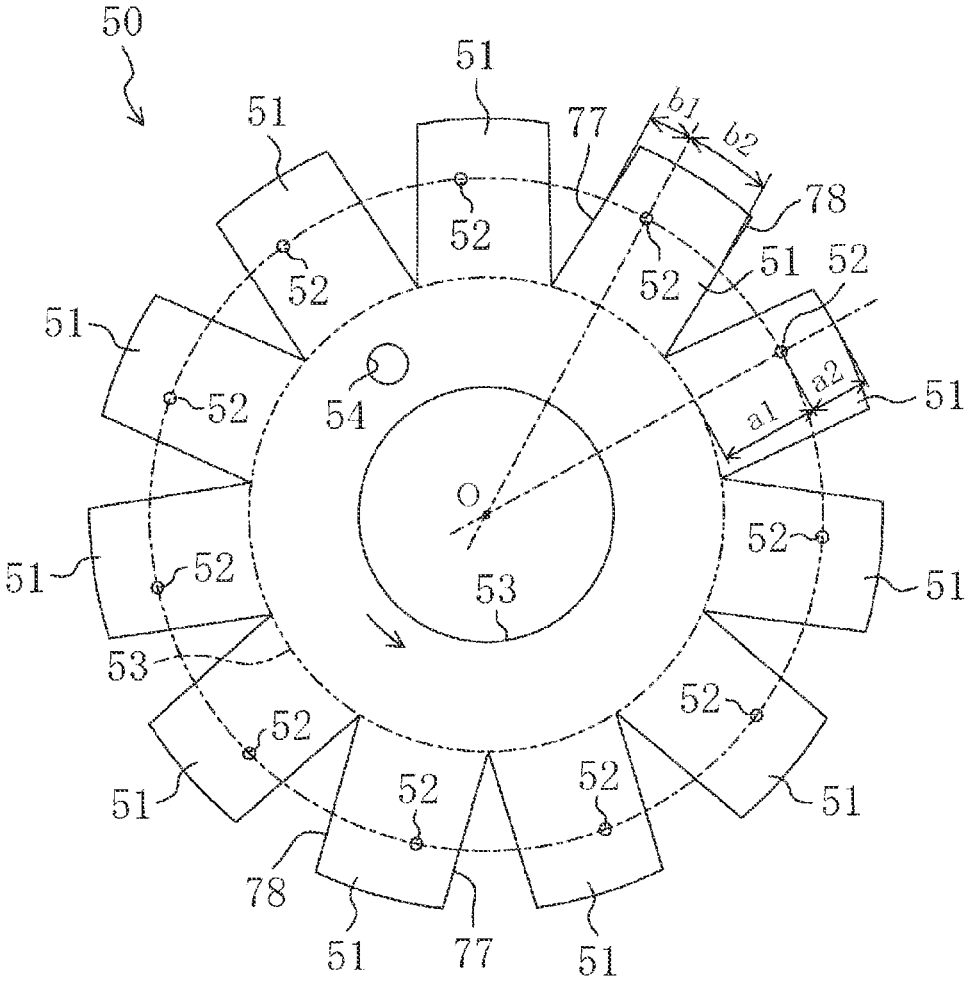
FIG. 14 is a plan view showing a gate rotor according to Variation 2 of the embodiment.

For example, the pressure introduction channel (52) may be opened in a portion of the front surface (75) of each gate (51) that is closer to the front edge (77) than the rear edge (78) in the rotation direction of the gate rotor (50), as shown in FIG. 14.

Specifically, on the front surface of each gate (51) shown in FIG. 14, the pressure introduction channel (52) is opened in a portion that is closer to the distal end of the gate (51) with respect to the center of the gate (51) in the longitudinal direction thereof. That is, on the front surface of each gate (51), the distance a1 from the outer periphery of the base portion (53) to the center of the pressure introduction channel (52) is longer than the distance a2 from the center of the pressure introduction channel (52) to the distal end of the gate (51). On the front surface of each gate (51) shown in the figure, the pressure introduction channel (52) is opened in a portion that is closer to the front edge of the gate (51) with respect to the center of the gate (51) in the width direction thereof. That is, on the front surface of each gate (51), the distance b1 along the pitch circle from the center of the pressure introduction channel (52) to the front edge of the gate (51) is shorter than the distance b2 along the pitch circle from the center of the pressure introduction channel (52) to the rear edge of the gate (51).

Figure 15:
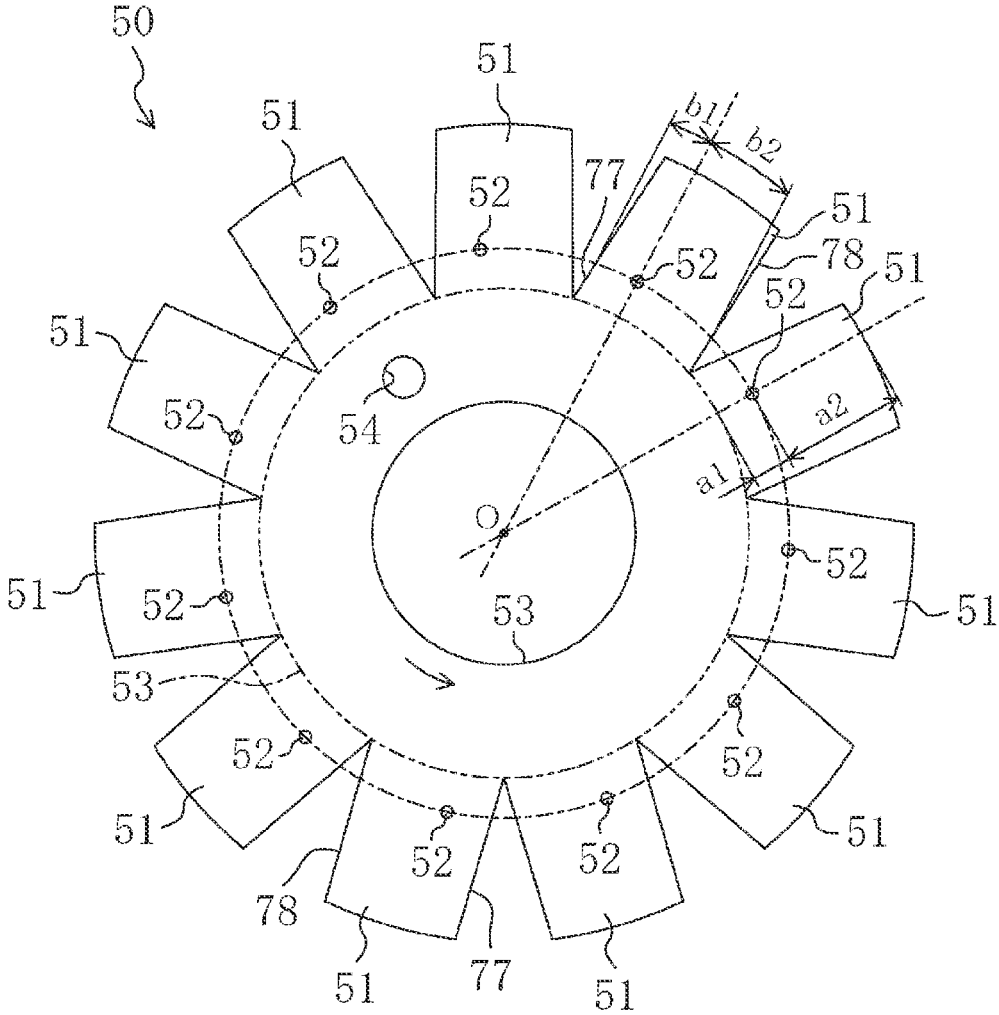
FIG. 15 is a plan view showing the gate rotor according to Variation 2 of the embodiment.

As shown in FIG. 15, on the front surface of each gate (51), the pressure introduction channel (52) may be opened in a portion that is close to the proximal end of the gate (51) and close to a front side in the rotation direction of the gate rotor (50).

Specifically, on the front surface of each gate (51) shown in FIG. 15, the pressure introduction channel (52) is opened in a portion that is closer to the proximal end of the gate (51) with respect to the center of the gate (51) in the longitudinal direction thereof. That is, on the front surface of each gate (51), the distance a1 from the outer periphery of the base portion (53) to the center of the pressure introduction channel (52) is shorter than the distance a2 from the center of the pressure introduction channel (52) to the distal end of the gate (51). On the front surface of each gate (51) shown in the figure, the pressure introduction channel (52) is opened in a portion that is closer to the front edge of the gate (51) with respect to the center of the gate (51) in the width direction thereof. That is, on the front surface of each gate (51), the distance b1 along the pitch circle from the center of the pressure introduction channel (52) to the front edge of the gate (51) is shorter than the distance b2 along the pitch circle from the center of the pressure introduction channel (52) to the rear edge of the gate (51).

Note that the opening position of the pressure introduction channel (52) on the front surface of a gate (51) is preferably set so that the pressure introduction channel (52) communicates with the compression chamber (23) on the front surface side of the gate (51) at a point in time when the compression chamber (23) is brought to a closed state (i.e., in a state where it is shut off from the low pressure space (S1)) or as soon as possible since the compression chamber (23) is brought to a closed state. This is because after the compression chamber (23) is brought to a closed state, the internal pressure of the compression chamber (23) gradually increases, and it is therefore preferable to keep at a low level the internal pressure difference between the compression chamber (23) and the back pressure space (65) by quickly introducing the internal pressure of the compression chamber (23) into the back pressure space (65).

The opening position of the pressure introduction channel (52) on the front surface of a gate (51) is preferably set so that the gate (51) stays in communication with the compression chamber (23) for as long a period as possible so long as the gate (51) does not come into contact with the side sealing surface (32). After the pressure introduction channel (52) is shut off from the compression chamber (23), the internal pressure of the back pressure space (65) is generally equal to or somewhat lower than that at a point in time when the pressure introduction channel (52) is shut off from the compression chamber (23). On the other hand, in the compression phase, the internal pressure of the compression chamber (23) gradually increases even after the pressure introduction channel (52) is shut off from the compression chamber (23). Therefore, after the pressure introduction channel (52) is shut off from the compression chamber (23), the internal pressure difference between the back pressure space (65) and the compression chamber (23) increases, thereby increasing the amount of deformation of the gate (51). However, as described above, if the period over which the pressure introduction channel (52) is in communication with the compression chamber (23) is too long, the gate (51) expands to the front surface side by receiving the internal pressure of the back pressure space (65), and the gate (51) may come into contact with the side sealing surface (32). Therefore, the point in time at which the pressure introduction channel (52) of the gate (51) comes off the compression chamber (23) is preferably set to be as late as possible so long as the gate (51) does not come into contact with the side sealing surface (32).

-Variation 3 of Embodiment-

Figure 16:
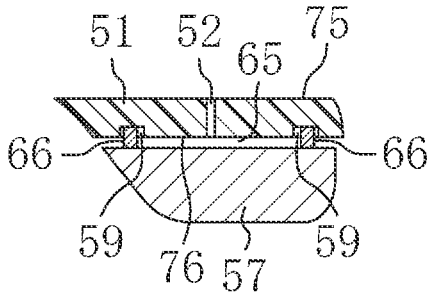
FIG. 16 is similar to FIG. 7, showing a gate rotor assembly according to Variation 3 of the embodiment.

In the gate rotor assembly (60) of the present embodiment, the sealing ring (66) may be attached to the gate (51) as shown in FIG. 16, as opposed to the gate supporting portion (57). In this variation, the depressed groove (59) is formed on the back surface of the gate (51). The sealing ring (66) is fitted in the depressed groove (59) of the gate (51) so as to be in contact with the front surface of the gate supporting portion (57).

-Variation 4 of Embodiment-

Figure 17:
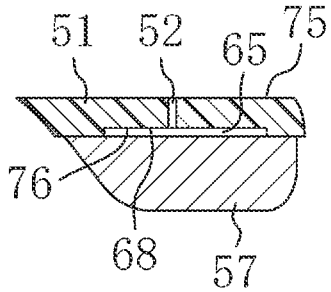
FIG. 17 is similar to FIG. 7, showing a gate rotor assembly according to Variation 4 of the embodiment.
Figure 18:
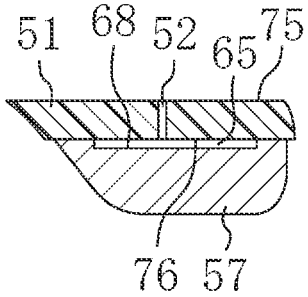
FIG. 18 is similar to FIG. 7, showing a gate rotor assembly according to Variation 4 of the embodiment.

In the gate rotor assembly (60) of the present embodiment, a depression (68) may be formed in the back surface of the gate (51) and covered by the gate supporting portion (57), thus forming the back pressure space (65), as shown in FIG. 17. Alternatively, the depression (68) may be formed in the front surface of the gate supporting portion (57) and covered by the gate (51), thus forming the back pressure space (65), as shown in FIG. 18.

In the gate rotor assembly (60) of this variation, the depression (68) formed in the gate (51) or the gate supporting portion (57) is in a rectangular shape that is slightly smaller than the front surface of the gate supporting portion (57) as viewed from above. In the gate rotor assembly (60) of this variation, the periphery of the back pressure space (65) is sealed by the gate (51) and the gate supporting portion (57) in contact with each other.

Note that the embodiment described above is essentially a preferred embodiment, and is not intended to limit the scope of the present invention, the applications thereof, or the uses thereof.

Industrial Applicability

As describe above, the present invention is useful for a single-screw compressor.

What is claimed is:

1. A single-screw compressor comprising:

a casing;

a screw rotor rotatably accommodated in the casing;

a gate rotor including a plurality of flat-plate-shaped gates formed in a radial pattern and meshing with a helical groove of the screw rotor; and a gate rotor supporting member rotatably supporting the gate rotor, the single-screw compressor compressing a fluid in a compression chamber defined by the screw rotor, the casing and the gates when the screw rotor is rotated, the gate rotor supporting member including a plurality of gate supporting portions supporting the gates from a back surface side thereof, and the gate rotor and the gate rotor supporting member forming a gate rotor assembly including a plurality of pressure introduction channels, each pressure introduction channel being configured and arranged to introduce a fluid pressure from a front surface side of one of the gates into a back pressure space between a back surface of the gate and the gate supporting portion supporting the gate.

2. The single-screw compressor of claim 1, wherein each pressure introduction channel is at least one through hole extending in a thickness direction through one of the gates.

3. The single-screw compressor of claim 2, wherein each pressure introduction channel opens in a portion of a front surface of each gate closer to a proximal end of the gate than a distal end of the gate in a radial direction of the gate rotor.

4. The single-screw compressor of claim 2, wherein each pressure introduction channel opens in a portion of a front surface of each gate closer to a front edge than a rear edge in a rotation direction of the gate rotor.

5. The single-screw compressor of claim 1, wherein a periphery of each back pressure space is surrounded by a sealing member.

6. The single-screw compressor of claim 5, wherein each sealing member is arranged along a peripheral portion of one of the gate supporting portions.

7. The single-screw compressor of claim 5, wherein each sealing member is attached to one of the gate rotor and the gate rotor supporting member, and each sealing member is in contact with the other one of the gate rotor and the gate supporting member in order to define the back pressure spaces.

8. A single-screw compressor comprising:

a casing;

a screw rotor rotatably accommodated in the casing;

a gate rotor including a plurality of flat-plate-shaped gates formed in a radial pattern and meshing with a helical groove of the screw rotor; and a gate rotor supporting member rotatably supporting the gate rotor, the single-screw compressor compressing a fluid in a compression chamber defined by the screw rotor, the casing and the gates when the screw rotor is rotated, the gate rotor supporting member including a plurality of gate supporting portions supporting the gates from a back surface side thereof, a back pressure space is fbnned between a back surface of each gate of the gate rotor and the gate supporting portion supporting the gate, and each gate includes at least one pressure introduction hole extending through the gate in a thickness direction thereof and communicating with the back pressure space facing a back surface of the gate.

9. The single-screw compressor of claim 8, wherein each pressure introduction hole is opened in a portion of a front surface of each gate that is closer to a proximal end of the gate than a distal end of the gate in a radial direction of the gate rotor.

10. The single-screw compressor of claim 8, wherein each pressure introduction hole is opened in a portion of a front surface of each gate that is closer to a front edge than a rear edge of each gate in a rotation direction of the gate rotor.

11. The single-screw compressor of claim 8, wherein a sealing member surrounding a periphery of each back pressure space is formed between each gate and the gate supporting portion supporting the gate.

12. The single-screw compressor of claim 11, wherein each sealing member is arranged along a peripheral portion of one of the gate supporting portions.

13. The single-screw compressor of claim 11, wherein each sealing member is attached to one of the gate rotor and the gate rotor supporting member, and each sealing member is in contact with the other one of the gate rotor and the gate supporting member in order to define the back pressure spaces.

* * * * *